US006997510B2

(12) United States Patent
Guillot et al.

(10) Patent No.: US 6,997,510 B2
(45) Date of Patent: Feb. 14, 2006

(54) ROCKING CHAIR WITH AUTOMATIC LOCKING MECHANISM

(75) Inventors: Roger Guillot, Saint-Anselme (CA); Claudel Chouinard, Sainte-Perpetue (CA); Francis Chouinard, Sainte-Perpetue (CA)

(73) Assignee: Norteck, Quebec (CA)

( * ) Notice: Subject to any disclaimer, the term of this patent is extended or adjusted under 35 U.S.C. 154(b) by 26 days.

(21) Appl. No.: 10/896,205

(22) Filed: Jul. 21, 2004

(65) Prior Publication Data

US 2005/0062322 A1 Mar. 24, 2005

(30) Foreign Application Priority Data

Aug. 7, 2003 (CA) ..... 2436745

(51) Int. Cl.
*A47C 3/03* (2006.01)

(52) U.S. Cl. ..... 297/270.1; 297/270.2; 297/270.4

(58) Field of Classification Search ..... 297/270.1, 297/270.2, 270.4
See application file for complete search history.

(56) References Cited

U.S. PATENT DOCUMENTS

| | | | | |
|---|---|---|---|---|
| 4,438,973 | A | 3/1984 | LaPointe | |
| 5,203,433 | A | 4/1993 | Dugas | |
| 6,120,094 | A | 9/2000 | Parent | 297/270.1 |
| 6,213,551 | B1 | 4/2001 | Desnoyers et al. | 297/270.2 |
| 6,244,658 | B1 | 6/2001 | Parent et al. | 297/270.1 |
| 6,402,242 | B1 | 6/2002 | Bellefleur | 297/270.1 |
| 6,406,095 | B1 | 6/2002 | Bouchard et al. | 297/270.1 |
| 6,464,295 | B1 | 10/2002 | Bergeron et al. | 297/270.4 |
| 6,588,841 | B1 * | 7/2003 | Hoffman et al. | 297/270.2 X |

* cited by examiner

*Primary Examiner*—Rodney B. White
(74) *Attorney, Agent, or Firm*—Fay Kaplun & Marcin, LLP

(57) ABSTRACT

A rocking chair comprising a base, a seat assembly including a seat rockably mounted to the base and a backrest mounted to the seat so as to be movable between first and second positions includes a couple of biasing members mounted to the backrest for biasing the backrest towards the first position, and a locking mechanism mounted to both the base and the seat assembly for locking the seat relatively to the base when the backrest is in the first position. The locking mechanism is operated by applying at least a threshold force onto the backrest, which causes the backrest to move between the first and second positions relatively to the seat, unlocking the backrest relatively to the base, and allowing the seat to move relatively to the base. The locking mechanism includes a toothed rack and an arm lever that operatively cooperate in response to a small force exerted on the backrest. The rocking chair is safe for people having hand or forearm disability problem and for people with reduced mobility.

14 Claims, 4 Drawing Sheets

ROCKING CHAIR WITH AUTOMATIC LOCKING MECHANISM

FIELD OF THE INVENTION

The present invention relates to rocking chairs. More specifically, the present invention is concerned with a locking chair provided with an automatic locking mechanism.

BACKGROUND OF THE INVENTION

Rocking chairs provided with a locking mechanism for preventing rocking movements while a person attempts to rise from the chair or to sit thereon have been known since many years. Generally, the chair comprises a fixed base, a seat rockably mounted to the base, and a locking mechanism mounting to the chair for selectively immobilizing the seat relatively to the base.

Locking mechanism comes in two flavours: manually operated and automatic. Examples of rocking chairs equipped with a manually operated locking mechanism are described in the U.S. Pat. No. 6,120,094, issued to Parent on Sep. 19, 2000 and entitled "Rocking Chair with Automatic Locking Device", and in the U.S. Pat. No. 6,213,551, entitled "Chair Locking Mechanism", issued to Desnoyers et al. on Apr. 10, 2001.

A drawback of such rocking chairs is that the lever of the locking mechanism may be difficult to operate for people having hand or forearm disability problems and for people with reduced mobility.

Bouchard et al., in the U.S. Pat. No. 6,406,095, issued on Jun. 18, 2002 and entitled "Self-Locking Mechanism" propose a solution to the above-mentioned drawback in the form of a locking mechanism intended to be automatically actuated while the occupant is still assuming a normal sitting position. The proposed locking mechanism comprises a detector for establishing whether a person is sitting on the chair, a lock, and an actuator for unlocking the lock when the presence of the person on the chair has been detected. The detector is responsive to pressure onto the backrest of the chair.

A first drawback of Bouchard's self-locking mechanism is the important number of its components and its complexity, yielding a mechanism bound to malfunction and an overall chair expensive to manufacture. A second drawback is that Bouchard's self-locking mechanism is uncomfortable and difficult to operate.

OBJECTS OF THE INVENTION

An object of the present invention is therefore to provide an improved locking mechanism for a rocking chair.

SUMMARY OF THE INVENTION

More specifically, in accordance with the present invention, there is provided a rocking chair comprising:

a base;

a seat assembly movably mounted to the base; the seat assembly including a seat and a backrest; the backrest being movable between first and second backrest position's relatively to the seat;

at least one biasing member mounted to the backrest for biasing the backrest towards the first backrest position; and an automatic locking mechanism mounted to both the base and the seat assembly for locking the seat relatively to the base when the backrest is in the first backrest position;

whereby, in operation, applying at least a threshold force onto the backrest causes the backrest to move between the first and second backrest positions relatively to the seat, unlocking the backrest relatively to the base, and allowing the seat to move relatively to the base.

Other objects, advantages and features of the present invention will become more apparent upon reading the following non restrictive description of preferred embodiments thereof, given by way of example only with reference to the accompanying drawings.

It is to be noted that the expression "rockably" used herein in reference to the movement of the seat relatively to the base is to be construed so as to encompass any movable relationship between the seat or the seat assembly and the base, including but not limited to rocking, swinging, rotating, and any other more complex movement.

DETAILED DESCRIPTION

Figure 1:
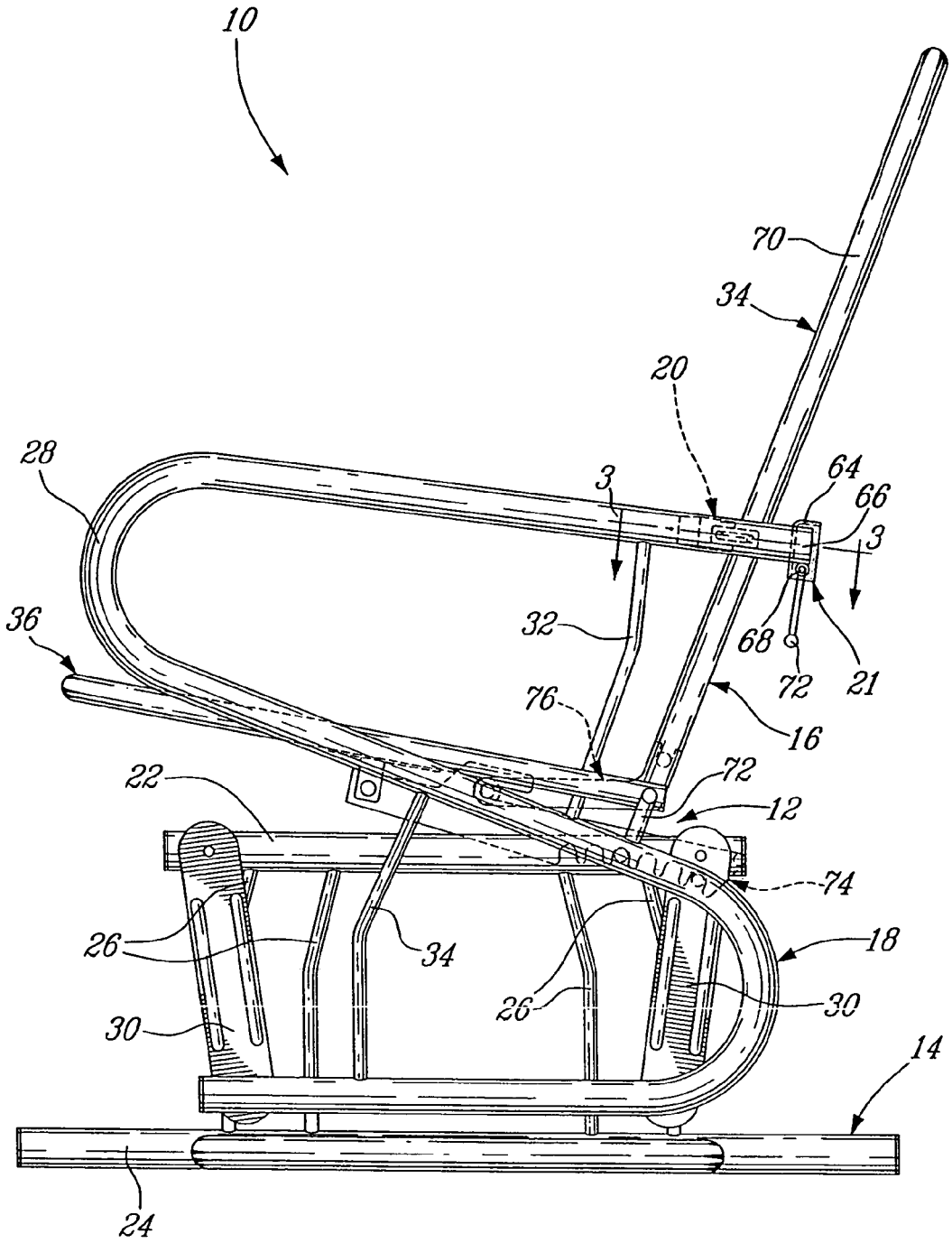
FIG. 1 is a side elevation view of a rocking chair according to an illustrative embodiment of the present invention.
Figure 2:
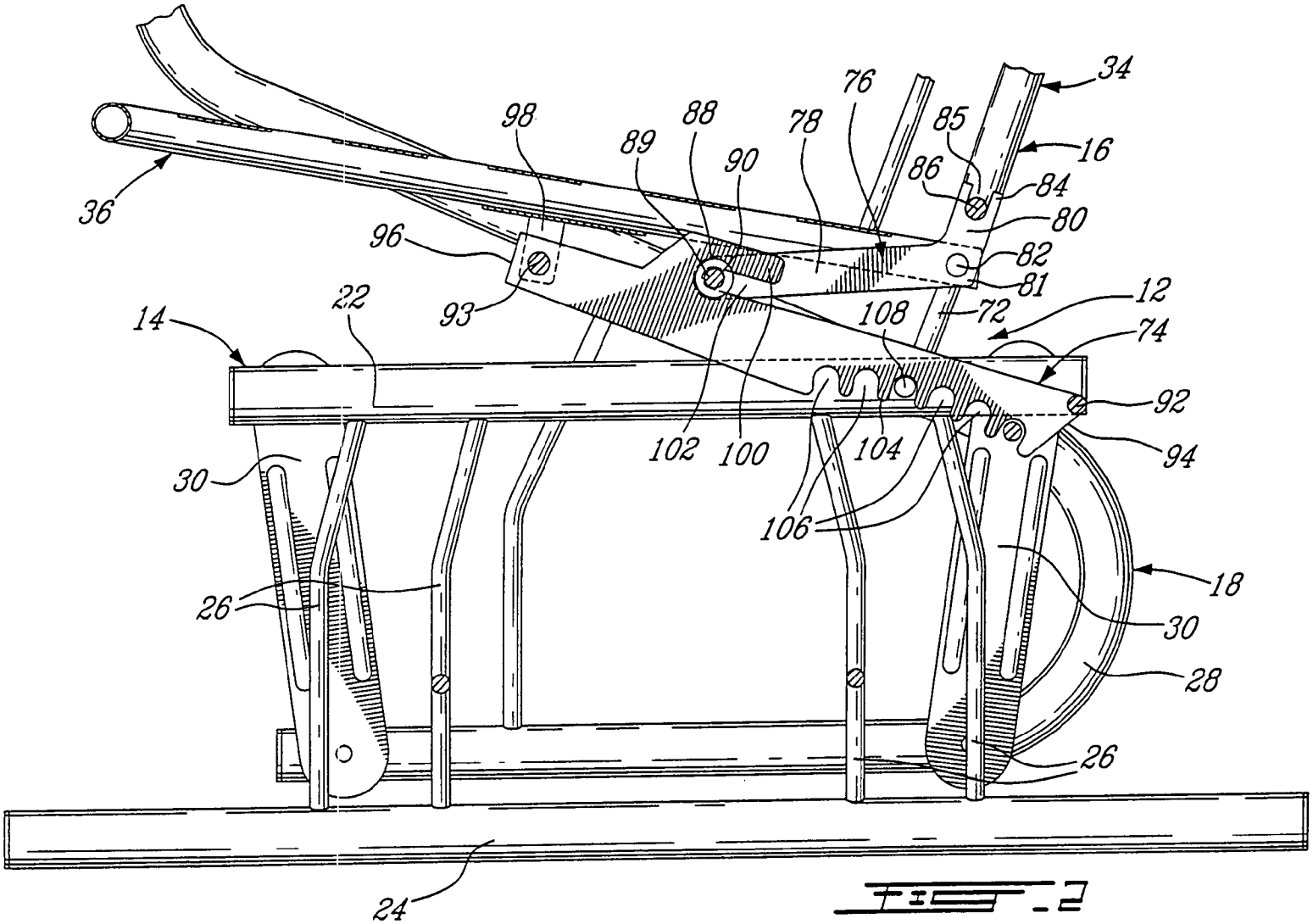
FIG. 2 is a partial cross section of the rocking chair from FIG. 1, illustrating the rocking chair in a locked configuration.

Turning now to FIGS. 1 and 2 of the appended drawings, a rocking chair 10 provided with an automatic locking mechanism 12 according to an illustrative embodiment of the present invention is illustrated.

The rocking chair 10 comprises a base 14, a seat assembly 16 including a seat 36 rockably mounted to the base 14 via a frame assembly 18 and a backrest 34 mounted to the seat 36 so as to be movable between first and second positions, a pair of biasing members 20 (only one shown), each mounted to both the backrest 34 and to the seat 36 via the frame assembly 18, for biasing the backrest 34 towards the first position, an automatic locking mechanism 12, and a safety locking mechanism 21. Each of these components of the rocking chair 10 and their relationships will now be described in more detail.

The base 14 includes bottom and top rectangular frames 22–24, the top frame 22 being biased from the bottom frame 24 and supported by the rods 26. The base 14 and more specifically the bottom rectangular frames 22 are configured and sized so as to provide stability to the chair 10. Of course, the base 14 may have other configuration allowing supporting and rockably mounting the seat assembly 16 via the frame assembly 18.

The frame assembly 18 includes two tubular generally S-shape frame members 28 (only one shown), each rockably mounted to a side of the rectangular base 14 via two elongated mounting members 30. The S-shape members 28 are in the form of bended hollow tubing. The upper portion of each S-shape member 28 defines an armrest.

More specifically, a first longitudinal end of each mounting member 30 is pivotally mounted to the bottom leg of a respective S-shape member 28 near a longitudinal end thereof, while the other longitudinal end of the mounting member 30 is pivotally mounted to a beam of the top rectangular frame 22 near a longitudinal end thereof so as to allow a rocking movement between the S-shape member 28 and the frame assembly 14.

The S-shape members 28 are mounted to opposite sides of the base 14. Each mounting member 30 is secured near the respective corners of the rectangular frames 22–24 so as to improve stability. For that same purpose, the bottom frame 24 is oversized with respect to the top frame 22.

Each S-shape member 28 includes reinforced rods 32 and 34 between respectively the top and bottom leg portions and the center portion of the S-shape member 28.

Of course, the frame assembly 18 may have other configurations allowing to rockably mounting the seat assembly 16 to the base 14.

The backrest 34 of the seat assembly 16 is pivotally secured to both S-shape members 28 of the frame assembly 16 therebetween via the biasing members 20 (only one shown) near its top longitudinal end and via the automatic locking mechanism 12 near its bottom longitudinal end. The operational relationship between the backrest 34 and the S-shape members 28 via the automatic locking mechanism 12 will be described hereinbelow in more detail.

The seat 36 is mounted to the S-shape member 28 and to the automatic locking mechanism 12 via mounting elements such as the mounting brackets 72 and 98 respectively.

Figure 3:
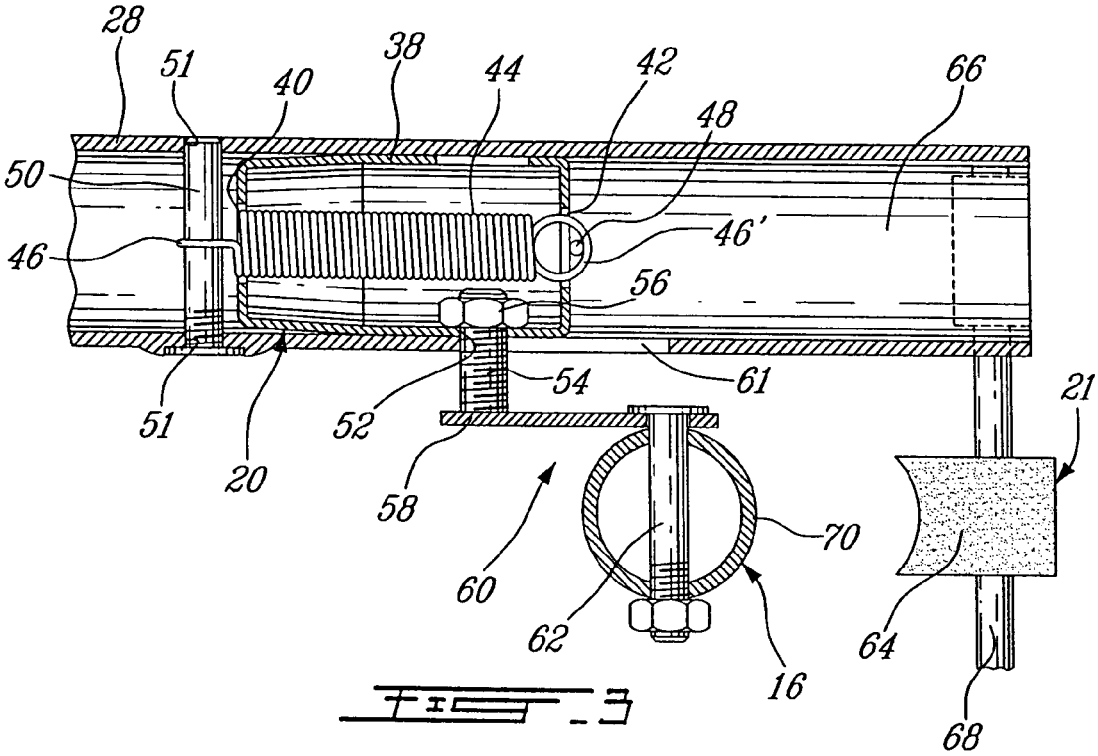
FIG. 3 is a cross section taken along line 3—3 on FIG. 1, illustrating a biasing member according to an illustrative embodiment of a secondary aspect of the present invention, the biasing member being illustrated in a passive configuration.

Turning now to FIG. 3, one of the two identical biasing members 20 and its operating relationship with a corresponding S-shape member 28 will be described in more detail.

The biasing member 20 is in the form of an elongated hollow body 38 including first and second longitudinal end openings 40–42 and a spring 44 extending therein from the first to the second longitudinal opening 40–42. The two end rings 46'–46 of the spring 44, located respectively at the proximate and distal ends thereof, are bent so as to be oriented perpendicularly from the other rings of the spring and perpendicularly from one another. The spring 44 is configured and sized so that the two end rings 46–46' extend partially from their respective opening when the spring 44 is in a passive or non-working configuration. The end ring 46' is secured to the hollow body 38 near the second longitudinal end 42 via a spring pin 48. The end ring 46 is secured to the hollow tubing of the S-shape member 28 therein via a bolt 50 mounted to the hollow tubing through a transversal opening 51. The hollow body 38 is tapered near its distal end 40 so as to ease its longitudinal forward movement in the upper leg section of the S-shape member 28 when it is mounted therein during assembly.

A first transversal opening 52 in the hollow body 38 allows receiving a bolt 54 that is secured to the hollow body 38 via a complementary nut 56. The bolt 54 is fixedly mounted to a mounting plate 58 that is part of a mounting assembly 60 allowing to fixedly securing the hollow body 38 to the backrest 34. Of course, the S-shape member 28 includes an opening 61 configured and sized to allow passage for the bolt 54 and to allow a transversal course therein.

The mounting assembly 60 further includes a bolt 62 or any other fastening means for securing the mounting plate 58 to the tubular member of the backrest 34.

Of course, other fastening means can be used to secure the backrest 34 to the hollow body 38 and therefore to the S-shape member 28 since the hollow body 38 is mounted in the S-shape member 28.

In operation, the biasing member 20 is in its passive configuration illustrated in FIG. 3 when no force is exerted on the backrest 34 (see FIG. 1). The backrest 34 is then in its first position defining a first angle with the upper portion of the S-shape member 28. However, when a force is exerted on the backrest 34, the backward translation of the backrest 34 is transferred to the biasing member 20 via the mounting assembly 60 until the bolt 54 reach the end of its course as allowed by the dimension of the opening 61 (see FIG. 4). Also, at the end of its course, the biasing member 20 is stopped by the friction member 64. The biasing member 20 is then in a working configuration since it is tensioned. The biasing member 20 and more specifically the spring 44 is so configured that only a minimal pressure is required to move the backrest 34.

The backrest 34 is in its second position when the biasing member 20 is at the end of its course, abutting the friction member 64. In its second position, the backrest defines a second angle with the upper portion of the S-shape member 28, the second angle being greater than the first angle. It is reminded that the first angle is defined with the upper portion of the S-shaped member 28 when the backrest is in its first position.

The spring 44 may be replaced by other biasing means such as a stretchable band, for example made in rubber.

The biasing member 20 may take other forms allowing to force the backrest 34 in a first position until a sufficient force is exerted to move the backrest 34 in a second position. For example, the biasing member 20 may have other configurations allowing its cooperation with the backrest 34 when the backrest 34 is configured to perform other movements than tilting between the first and second position.

Also the biasing member 20 may be differently positioned. For example, a biasing member 20 may alternatively or additionally be directly mounted to both the backrest 34 and the seat 32 therebetween. The biasing member 20 may alternatively be positioned at a different location than illustrated in FIG. 1 between the frame assembly 18 and the backrest 34.

Figure 4:
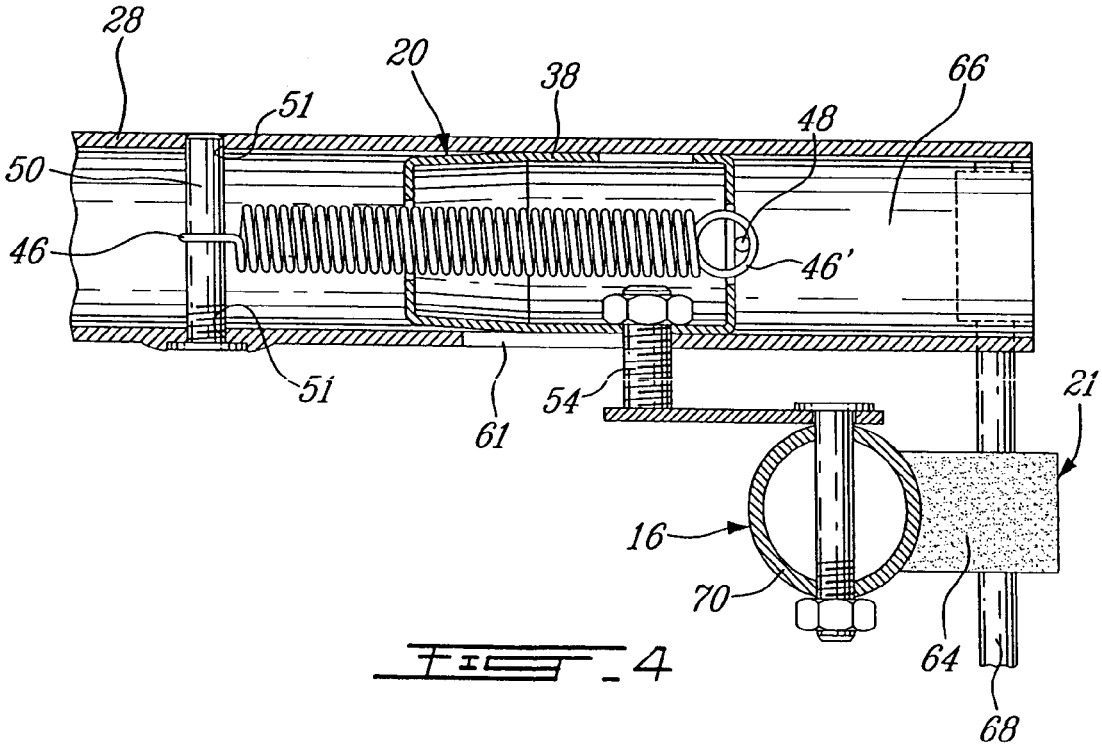
FIG. 4 is a cross section similar to FIG. 3 illustrating the biasing member in a working configuration.

Returning to FIG. 1, the safety locking mechanism 21 is in the form of two friction members 64 (only one shown) pivotally mounted to the upper end portion 66 of the S-shaped member 28 via a rod 68. The two friction members 64 are positioned along the rod 68 so as to engage lateral frame portions 70 of the backrest 34 while pivoting. A handle 72, fixedly mounted to both friction members 64, allows pivoting the friction members 64 between a first position where they contact the backrest 34 and a second position (as illustrated in FIGS. 1, 3 and 4), where it is sufficiently biased from the backrest to allow the hollow body 38 of the biasing member 20 to move its full course. In their first contacting position, the friction members 64 prevent any backward movement of the backrest 34. Moreover, as will become more apparent hereinbelow, the safety locking mechanism 21, while in its first position, prevents the rocking chair 10 from rocking.

Even though the safety locking mechanism 21 has been described has having two friction members 64, only one friction member may be used in preventing movements of the backrest 34 and therefore movements of the seat assembly 16 relative to the base 14.

The safety locking mechanism 21 may alternatively have another configuration allowing preventing movement of the backrest 34. For example, the safety locking mechanism 21 may be mounted to both the backrest 34 and base 14 or seat 36 and configured to selectively engage the two components 34 and 14 or 36 so as to prevent any relative movement therebetween.

The automatic locking mechanism 12 will now be described in more detail with reference to FIGS. 1, 2 and 5.

The automatic locking mechanism 12 includes a pair of toothed racks 74 and a pair of lever arms 76 operatively interconnected.

Each lever arm 76 includes an elongated portion 78 and an integral shorter portion 80 extending from the elongated portion 78 at an obtuse angle so as to generally define an open L-shape body having an elbow portion 81. Each arm 76 is pivotally mounted through its elbow portion 81 to a respective lateral side of the seat 36 via a pivot pin 82. The free end 84 of the shorter portion of each arm 36 is provided with a groove 85 to receive a first transversal rod 86 extending laterally side to side of the chair 10 in the backrest 34. The free end 88 of the elongated portion 78 includes an aperture 89 to pivotally mount the arm 76 to a second transversal rod 90 that is secured to both S-Shape members 28 therebetween. Therefore, the lever arm 76 interconnects the backrest 34 and the frame assembly 18.

The toothed racks 74 are mounted to each other via third and fourth transversal rods 92–93 that are positioned near each of their respective first and second longitudinal ends 94–96. A mounting bracket 98 allows to additionally pivotally mounting the fourth transversal rod 93 to the bottom of the seat 36. The arm 74 further includes a finger 100 extending from the rack 74 so as to define a groove 102 for receiving the second transversal rod 90 that acts as a second pivot axis for the arm 76. The finger 100 extends from the arm 76 at a position about one third of a distance'between the third and fourth transversal rod 92–93. Of course, the position of the finger may vary.

Each rack 74 also includes a toothed portion 104 defined by a plurality of grooves 106 each defining an arc. The grooves 106 are configured to selectively engage a small rod 108 protruding from the top rectangular frame 22 of the base 14 towards the interior of the base 14.

Then toothed rack 74 allows selectively interconnecting both the seat 36 and backrest 34 to the base so as to selectively prevent any rocking movement of the seat assembly 16 relatively to the base 14.

The plurality of grooves 106 allows to selectively locking the seat assembly 16 while the seat assembly 12 is in one of a plurality of position relatively to the base 16.

In operation, a person (not shown) unlocks the safety locking mechanism 21 by upwardly pivoting the handle 72 so as to disengage the resilient bodies 64 from the back of the lateral frame members 70 of the backrest 34, as illustrated in FIG. 1. Of course, the safety locking mechanism 21 is not required to be engaged between uses of the chair 10.

Without any force or pressure exerted on the backrest 34, the biasing member 20 (see FIG. 3) forces the backrest 34 in the locked position illustrated in FIGS. 1 and 2. In this locked position, the toothed rack 74 and lever arm 76 are so positioned that one of the grooves 106 engages the rod 108, which prevent any relative movements between the base 14 and the seat assembly 16. The longitudinal position of the toothed rack 74 relatively to the base 14 when a person wishes to get up from the chair 10 and therefore stops putting some pressure with its back on the backrest, determines which groove 106 engages the rod 108. Of course the number, size and configuration of the grooves 106, and the configuration and size of the rod 108 may vary. For example, the rod 108 may be replaced by a protrusion having another configuration.

Figure 5:
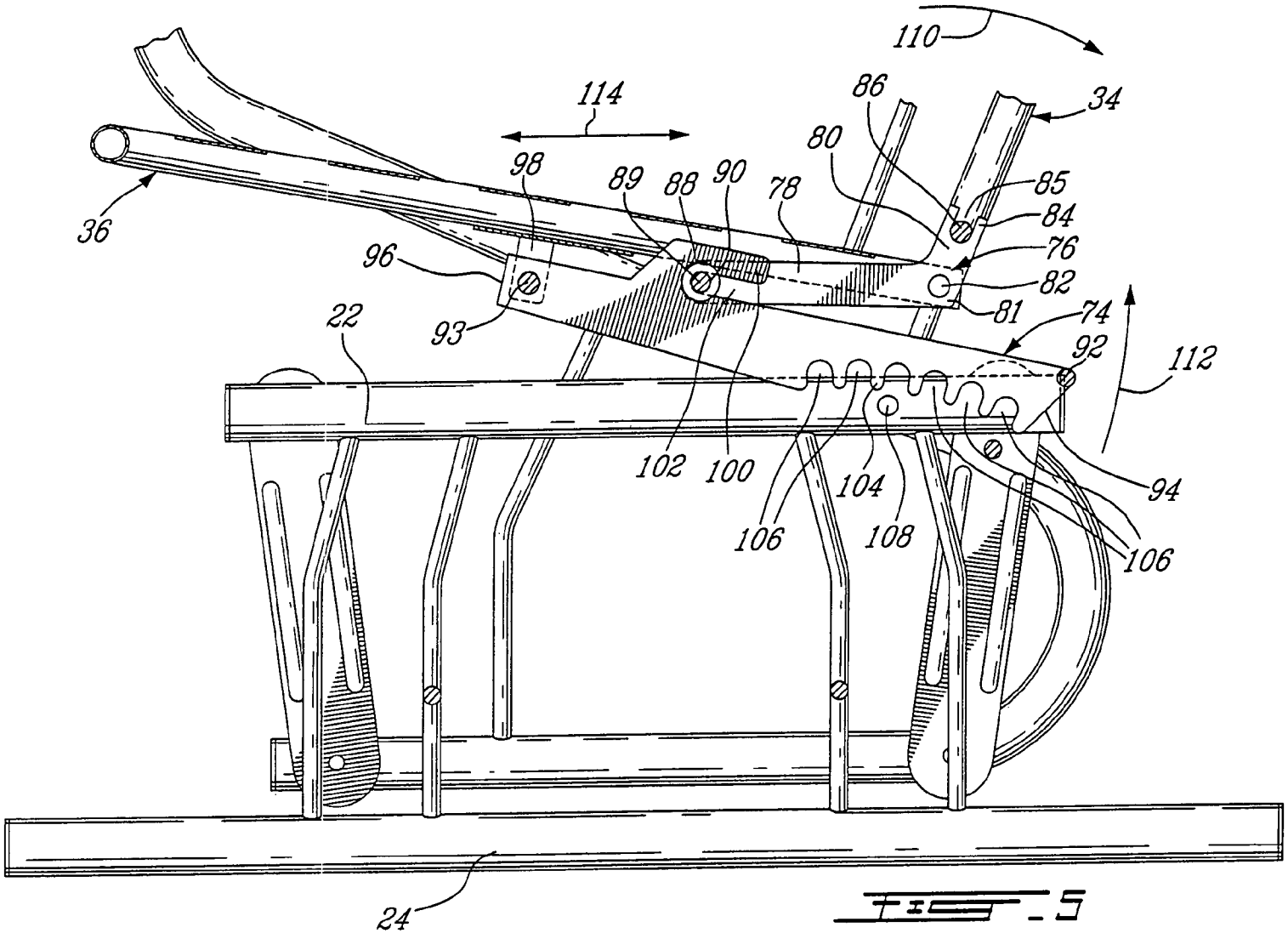
FIG. 5 is a cross section similar to FIG. 2, illustrating the rocking chair in an operating configuration.

When the safety locking mechanism 21 is unlocked and a person sitting in the chair 10 exerts a minimal force onto the backrest 34, the backrest 34 pivot backwardly as indicated by arrow 110 on FIG. 5.

The pivoting of the backrest 34 caused by exerting a pressure thereon causes the pivoting of the lever arm 76 in a way that its elongated portion 78 raises. Consequently, this causes the raising of the toothed portion 104 of the toothed rack 74 (see arrow 112 on FIG. 5), disengaging any engaged groove from the rod 108. This allows the S-shaped members 28, and therefore the seat assembly 18 mounted thereto, to freely swing in both longitudinal directions as indicated by arrows 114 in FIG. 5.

It is to be noted that the automatic locking mechanism 12 according to the present invention makes use of the lever effect, allowing the mechanism 12 to be disengage by persons having a weight as low as 40 kilograms for example, depending on the configuration and size of the locking mechanism.

Although the present invention has been described with reference to a rocking chair provided with a frame assembly including S-shape members, it is believed to be within the reach of a person having skills in the art to adapt the present invention to a rocking chair having other configuration and more specifically other frame assembly configuration.

Moreover, the configuration of the lever arm 76 and toothed rack 74 may vary. Also other cooperating means than grooves with a rod can be foreseen between the rack 74 and the base 16. The biasing member can also take other forms.

Even though the present invention as been described with reference to an illustrative embodiment wherein the seat or seat assembly is rockable relatively to the base, it is believed to be within the reach of a person skilled in the art to use the present teaching to adapt the automatic locking mechanism to a chair where a seat assembly is movably mounted to a base so as to allow another movement than rocking, such as rotation, tilting, etc.

Although the present invention has been described hereinabove by way of preferred embodiments thereof, it can be modified without departing from the spirit and nature of the subject invention, as defined in the appended claims.

What is claimed is:

1. A rocking chair comprising:

a base;

a seat assembly movably mounted to the base; said seat assembly including a seat and a backrest; said backrest being movable between first and second backrest positions relative to said seat;

at least one biasing member mounted to said backrest for biasing said backrest towards said first backrest position; and an automatic locking mechanism mounted to both said base and said seat assembly for locking said seat relative to said base when said backrest is in said first backrest position; said automatic locking mechanism being mounted to said seat assembly via said backrest wherein said automatic locking mechanism includes a rack pivotably mounted to said seat for selectively engaging said base and a lever arm mounted to said backrest for selectively engaging said rack; said lever arm being pivotably mounted to said frame assembly;

whereby, in operation, applying at least a threshold force onto said backrest said base causes said backrest to move between said first and second backrest positions relative to said seat, which causes said lever arm to pivot thereby exerting a force onto said rack so as to disengage said rack from said base thereby allowing said seat to move relatively to said base.

2. A rocking chair as recited in claim 1, wherein said lever arm has two elongated portions extending from an elbow portion; one of said two elongated portions being secured to said backrest; the other of said two elongated portions engaging said rack.

3. A rocking chair as recited in claim 2, wherein one of said two elongated portions of said lever arm being longer than the other, providing for a lever effect onto said rack.

4. A rocking chair as recited in claim 1, wherein said base includes a protrusion and said rack includes at least one groove for receiving said protrusion.

5. A rocking chair as recited in claim 4, wherein said rack includes a toothed portion having a plurality of grooves for selectively engaging said protrusion while said seat assembly is in one of a plurality of position relatively to said base.

6. A rocking chair as recited in claim 1, wherein said rack includes a finger defining a slot for receiving one of said two elongated portion of said lever arm.

7. A rocking chair comprising:

a base;

a seat assembly movably mounted to the base; said seat assembly including a seat and a backrest; said backrest being movable between first and second backrest positions relative to said seat;

at least one biasing member mounted to said backrest for biasing said backrest towards said first backrest position; and an automatic locking mechanism mounted to both said base and said seat assembly for locking said seat relative to said base when said backrest is in said first backrest position; said automatic locking mechanism being mounted to said seat assembly via said backrest; said seat being movably mounted to said base via a frame assembly; said frame assembly includes two frame members, each of said two frame members being movably mounted to said base on respective lateral sides thereof; said seat being fixedly mounted to both said two frame members therebetween; said at least one biasing member comprising two biasing members; said backrest having top and bottom longitudinal ends; said backrest being pivotably mounted near said bottom longitudinal end thereof to both said two frame members therebetween and being mounted near said top longitudinal end thereof to both said two frame members therebetween via respective said two biasing members.

8. A rocking chair as recited in claim 7, wherein each of said two frame members includes a hollow tubing portion; each of said two biasing members including an elongated body and a spring having two longitudinal ends extending through said elongated body; one of said two longitudinal ends of said spring being secured to one of said two frame members in said hollow tubing portion, the other of said two longitudinal ends of said spring being secured to said elongated body; said elongated body being secured to said backrest and being slidably mounted in said hollow tubing portion for reciprocating movement therein between an first elongated body position where said spring is in a passive configuration and where said backrest is in said first backrest position and a second elongated body position where said spring is tensioned; said spring biasing said backrest towards said first backrest position.

9. A rocking chair as recited in claim 8, wherein said hollow tubing portion including an elongated opening having two longitudinal ends; each of said elongated body being secured to said backrest via a mounting bracket received in a respective said elongated opening; said first elongated body position corresponding to said mounting bracket abutting said first longitudinal end of said opening and said second elongated body position corresponding to said mounting bracket abutting said second longitudinal end of said opening.

10. A rocking chair as recited in claim 8, wherein said elongated body having two longitudinal ends; one of said two longitudinal ends being tapered.

11. A rocking chair as recited in claim 7, further comprising a safety locking mechanism mounted to said frame assembly for selectively locking said backrest in said first backrest position; said safety locking mechanism including a friction member movably mounted to said frame assembly for selective engagement with said backrest, thereby forcing said backrest in said first backrest position.

12. A rocking chair as recited in claim 11, wherein said friction member is pivotably mounted to said frame assembly.

13. A rocking chair as recited in claim 7, further comprising a safety locking mechanism mounted to said seat assembly for selectively locking said backrest in said first backrest position.

14. A rocking chair as recited in claim 7, wherein said seat assembly is mounted to said base so as to allow a movement relatively to the base selected from the group consisting of rotation, tilting, and rocking.

* * * * *